US007574994B2

(12) United States Patent
Scheurer et al.

(10) Patent No.: US 7,574,994 B2
(45) Date of Patent: Aug. 18, 2009

(54) FUEL INJECTION SYSTEM

(75) Inventors: Hans-Peter Scheurer, Marbach (DE); Roger Busch, Esslingen (DE)

(73) Assignee: Robert Bosch GmbH, Stuttgart (DE)

( * ) Notice: Subject to any disclaimer, the term of this patent is extended or adjusted under 35 U.S.C. 154(b) by 65 days.

(21) Appl. No.: 11/628,632

(22) PCT Filed: Apr. 15, 2005

(86) PCT No.: PCT/EP2005/051680

§ 371 (c)(1),
(2), (4) Date: Sep. 4, 2007

(87) PCT Pub. No.: WO2005/119048

PCT Pub. Date: Dec. 15, 2005

(65) Prior Publication Data

US 2008/0149069 A1 Jun. 26, 2008

(30) Foreign Application Priority Data

Jun. 4, 2004 (DE) ..... 10 2004 027 507

(51) Int. Cl.
*F02M 63/00* (2006.01)
*F02M 37/00* (2006.01)

(52) U.S. Cl. ..... 123/447; 123/514

(58) Field of Classification Search ..... 123/446, 123/447, 456, 514
See application file for complete search history.

(56) References Cited

U.S. PATENT DOCUMENTS 5,339,785 A * 8/1994 Wilksch ..... 123/457
5,441,026 A 8/1995 Akimoto et al.
5,477,829 A * 12/1995 Hassinger et al. ..... 123/467
5,623,910 A * 4/1997 Riggle ..... 123/510
6,352,067 B1 * 3/2002 Genslak ..... 123/510
6,497,217 B2 * 12/2002 Kojima ..... 123/456
6,792,918 B1 9/2004 Halsall
6,988,488 B2 * 1/2006 Pursifull et al. ..... 123/467
7,066,152 B2 * 6/2006 Stroia et al. ..... 123/467
7,246,607 B2 * 7/2007 Burke et al. ..... 123/516
7,267,108 B2 * 9/2007 Barylski et al. ..... 123/457
7,278,402 B2 * 10/2007 Schelhas ..... 123/467
7,290,534 B2 * 11/2007 Fischer ..... 123/509
7,438,057 B2 * 10/2008 Scheurer et al. ..... 123/514
7,441,545 B1 * 10/2008 Fisher et al. ..... 123/467
2004/0206338 A1 * 10/2004 Pursifull et al. ..... 123/510
2004/0250795 A1 * 12/2004 Stroia et al. ..... 123/447

FOREIGN PATENT DOCUMENTS

DE 100 60 812 6/2002
DE 10 2004 018 888 11/2004

* cited by examiner

*Primary Examiner*—Thomas N Moulis
(74) *Attorney, Agent, or Firm*—Kenyon & Kenyon LLP

(57) ABSTRACT

A fuel injection system having a high-pressure accumulator, in which fuel may be stored at high pressure, at least one fuel injector via which the fuel located in the high-pressure accumulator may be injected into the combustion chamber of an internal combustion engine being connectable to the high-pressure accumulator. A high-pressure pump draws in fuel out of a leak fuel area, compresses it, and supplies it to the high-pressure accumulator, so that a high fuel pressure is built up therein during operation of the high-pressure pump. A return line having a regulating valve is implemented between the leak fuel area and the high-pressure accumulator, the regulating valve allowing a fuel flow from the leak fuel area into the high-pressure accumulator when the high-pressure pump is shut down.

4 Claims, 3 Drawing Sheets

FUEL INJECTION SYSTEM

FIELD OF THE INVENTION

The present invention is directed to a fuel injection system.

BACKGROUND INFORMATION

A fuel injection system is known, for example, from German Published Patent Application No. 100 60 812 and is preferably used for internal combustion engines. Such a fuel injection system has a high-pressure accumulator, in which fuel may be stored at high pressure. Connected to the high-pressure accumulator is at least one fuel injector via which the fuel provided at high pressure in the high-pressure accumulator may be injected into the combustion chamber of an internal combustion engine. A high-pressure pump, which draws in the fuel out of a leak fuel area and supplies it in compressed form to the high-pressure accumulator, is provided for producing the high pressure in the high-pressure accumulator. During operation of the high-pressure pump, a fuel pressure which is required for finely atomized fuel injection is thus built up in the high-pressure accumulator.

During operation of the internal combustion engine, the fuel in the high-pressure accumulator heats up, so that temperatures of over 50° C. may exist therein. After the internal combustion engine is shut down, the high-pressure pump is also shut down, so that the fuel remaining in the high-pressure accumulator cools over time until it has assumed the ambient temperature. The fuel in the high-pressure accumulator thus shrinks, approximately 1% per 10° C. The pressure in the high-pressure accumulator sinks correspondingly until the volume of the fuel in the high-pressure accumulator is less than the volume of the high-pressure accumulator itself. Outgassing of air from the fuel thus occurs, and this air fills up the volume in the high-pressure accumulator which becomes free. When the internal combustion engine is restarted, the air must first be compressed by the high-pressure pump before the desired high fuel pressure may be built up. This effect is noticeable due to a delayed pressure buildup, which may last up to two seconds and is thus clearly noticeable to the user of the internal combustion engine, which is operated in a motor vehicle, for example.

SUMMARY OF THE INVENTION

The fuel injection system according to the present invention has the advantage over the related art that the pressure buildup in a fuel injection system which operates according to the common rail principle occurs without noticeable delay. For this purpose a return line is implemented between the leak fuel area and the high-pressure accumulator, in which a regulating valve is implemented. The regulating valve operates in such a way that when the high-pressure pump is shut down, fuel may flow from the leak fuel area into the high-pressure accumulator. If the fuel in the high-pressure accumulator cools down, the cavity arising in the high-pressure accumulator due to the shrinkage of the fuel is filled up by fuel flowing in from the leak fuel area, so that the high-pressure accumulator always remains completely filled with fuel. Therefore, when the internal combustion engine is restarted and the high-pressure pump is thus started, no air has to be compressed, so that the pressure in the high-pressure accumulator increases very rapidly and is available for fuel injection.

In a first advantageous embodiment of the object of the present invention, the regulating valve is implemented as a check valve, the check valve only opening the fuel line when the pressure in the high-pressure accumulator is less than or equal to the pressure in the leak fuel chamber. It is thus ensured that no fuel pressure escapes from the high-pressure accumulator as long as the internal combustion engine is in operation. When the fuel in the high-pressure accumulator cools, a partial vacuum forms via which fuel is drawn in from the leak fuel area into the high-pressure accumulator, so that this always remains completely filled with fuel. The return line may be a separate line for this purpose, which leads directly from the high-pressure accumulator into the leak fuel chamber. However, it is also possible to provide the return line in parallel to the high-pressure pump, so that the intake line, via which the high-pressure pump draws in fuel out of the leak fuel area, and the high-pressure line, via which the fuel is supplied to the high-pressure accumulator at high pressure, are connected to one another directly via the return line.

In a further advantageous embodiment of the object of the present invention, the regulating valve is configured to be switchable, the regulating valve being switched open when the high-pressure pump is not in operation. A fuel flow is thus possible both from the high-pressure accumulator into the leak fuel chamber and the leak fuel chamber into the high-pressure accumulator. This results in rapid pressure equalization between the high-pressure accumulator and the leak fuel chamber. When the fuel cools in the high-pressure accumulator, it also always remains completely filled with fuel, as already described above. The switchable regulating valve is used during normal operation of the internal combustion engine as a pressure maintenance valve to keep the pressure in the high-pressure accumulator at a constant value, in that if a setpoint pressure is exceeded in the high-pressure accumulator, fuel is conducted out of the high-pressure accumulator and supplied via the pressure maintenance valve to the leak fuel area.

DETAILED DESCRIPTION

Figure 1:
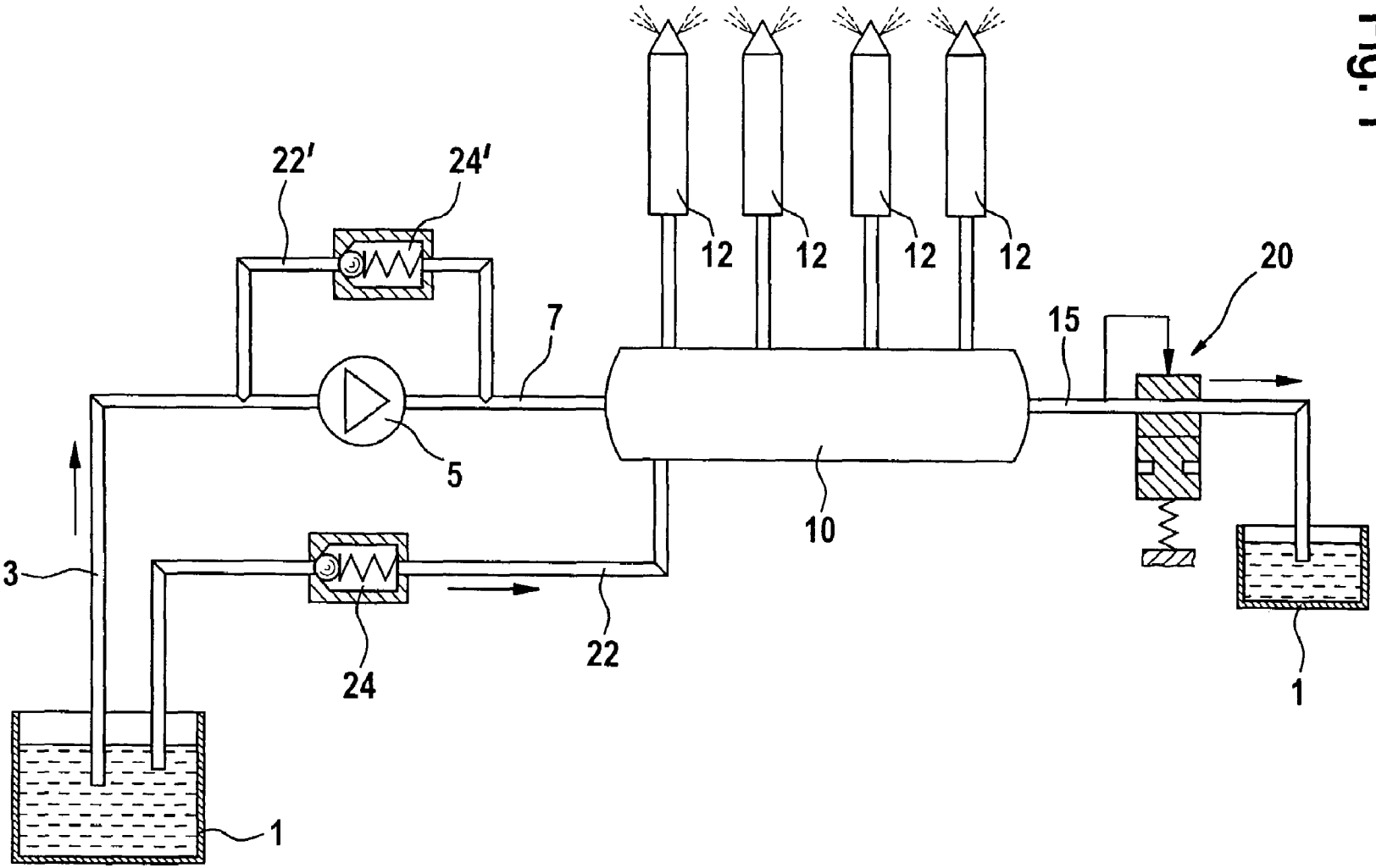
FIG. 1 shows a schematic illustration of an injection device.

FIG. 1 schematically shows a fuel injection system which operates using a common rail system. Fuel is provided at ambient pressure in a leak fuel area 1, leak fuel area 1 typically corresponding to the fuel tank in a vehicle. An intake line 3 leads from leak fuel area 1 to a high-pressure pump 5, in which fuel may be generated at high pressure. The fuel compressed at high pressure is supplied by high-pressure pump 5 via a high-pressure line 7 to a high-pressure accumulator 10, in which the fuel may be stored under high pressure. Connected to high-pressure accumulator 10 are multiple fuel injectors 12 via which the fuel which is stored in high-pressure accumulator 10 at high pressure may be injected into the combustion chamber of the internal combustion engine. Via corresponding regulating devices in high-pressure pump 5, it is generally provided that only as much fuel is supplied to high-pressure accumulator 10 as is taken therefrom for fuel injection. If too high a pressure nonetheless arises in high-pressure accumulator 10, a pressure regulating valve 20 is provided for limiting the pressure in a termination line 15, which connects high-pressure accumulator 10 to leak fuel area 1. Pressure regulating valve 20 is opened if a desired setpoint pressure in high-pressure accumulator 10 is exceeded, so that fuel drains off into leak fuel area 1 and reduces the pressure in high-pressure accumulator 10. If the pressure falls below the setpoint pressure again, pressure regulating valve 20 closes termination line 15 and thus stops further pressure drop.

Figure 2A:
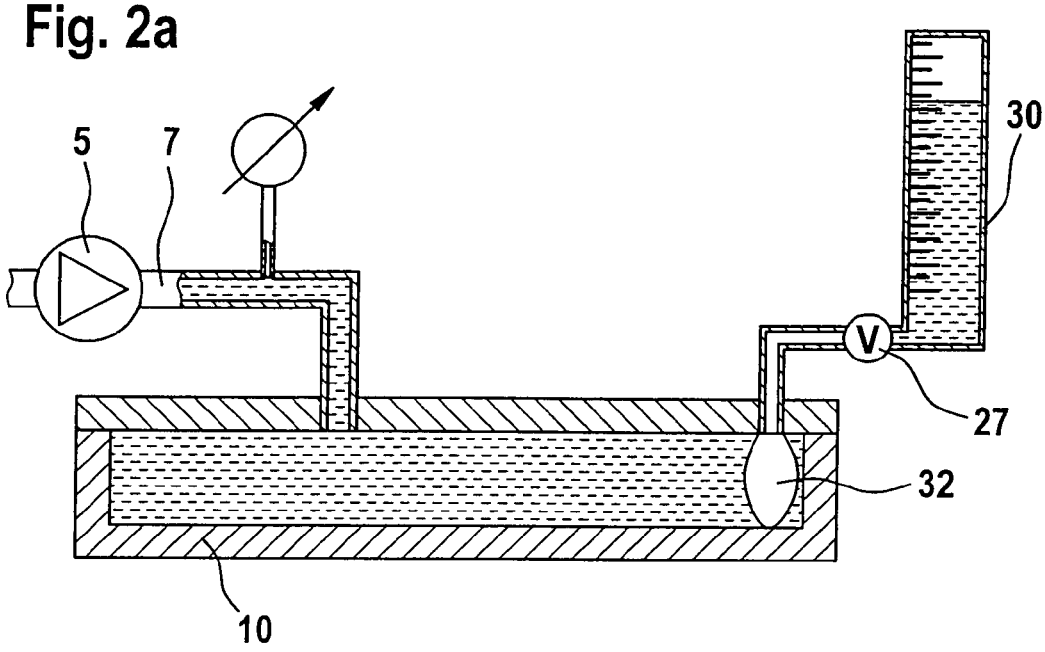
FIG. 2*a* also shows a schematic illustration of the high-pressure accumulator without return of fuel when the high-pressure pump is shut down.
Figure 2B:
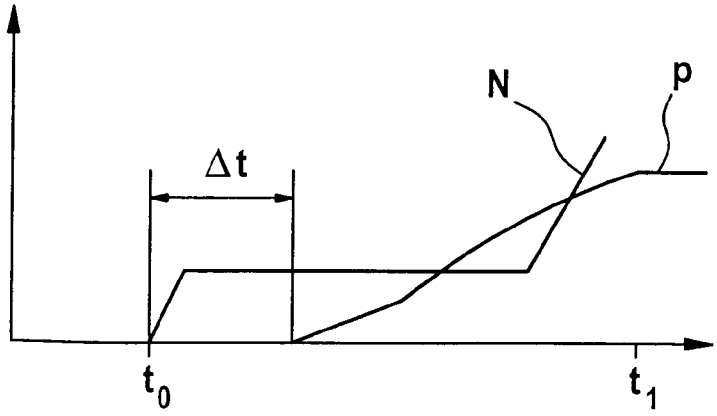
FIG. 2*b* shows the time curve of the pressure and speed of the internal combustion engine for the present invention.

FIG. 2 schematically shows high-pressure accumulator 10 and the hydraulic conditions which result therein as high-pressure accumulator 10 cools in the fuel injection systems known up to this point. High-pressure accumulator 10 is filled with fuel at high pressure via high-pressure pump 5. After the internal combustion engine is shut down, high-pressure pump 5 also no longer conveys fuel into high-pressure accumulator 10. Provided in FIG. 2 is an equalization container 30 which is connected to high-pressure accumulator 10 and whose connection to high-pressure accumulator 10 may be interrupted by a valve 27. If valve 27 is closed after the internal combustion engine is shut down, no fuel may flow from equalization container 30 into high-pressure accumulator 10. A cavity forms due to the cooling of the fuel in high-pressure accumulator 10, and is filled with air outgassing from the fuel and forms an air bubble 32. When the internal combustion engine, and thus also high-pressure pump 5, are turned on again, the fuel in high-pressure accumulator 10 is compressed. Due to air bubble 32, which is highly compressible in comparison to the fuel, the pressure buildup in high-pressure accumulator 10 is delayed, as shown in FIG. 2*b*, which shows the curve of pressure p and speed N of an internal combustion engine as it is restarted. At instant $t_0$, high-pressure pump 5 is put into operation, and speed N of the internal combustion engine reaches a first value relatively rapidly. Due to the compression of air bubble 32 in high-pressure accumulator 10, the pressure buildup first occurs with a delay $\Delta t$, which may be up to two seconds in passenger vehicle applications, depending on the high-pressure volume, delivery rate, and temperature difference. When the pressure of high-pressure accumulator 10 has reached a specific value, higher speeds of the internal combustion engine are possible.

Figure 3A:
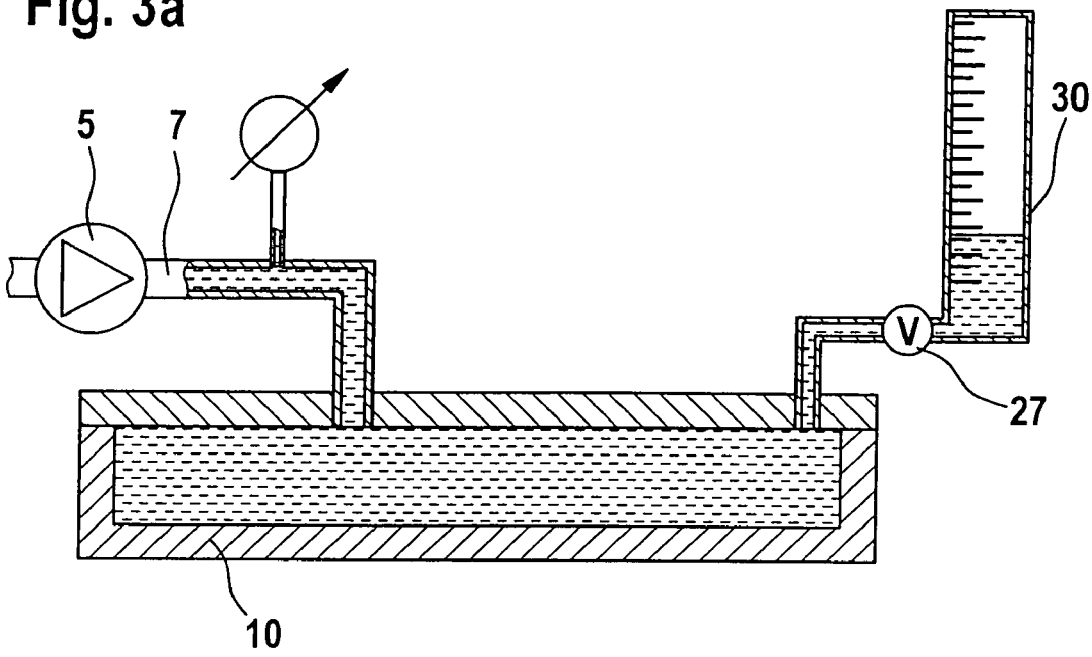
FIG. 3*a* shows, in the same view as FIG. 2*a*, the case in which the high-pressure accumulator is always filled with fuel.
Figure 3B:
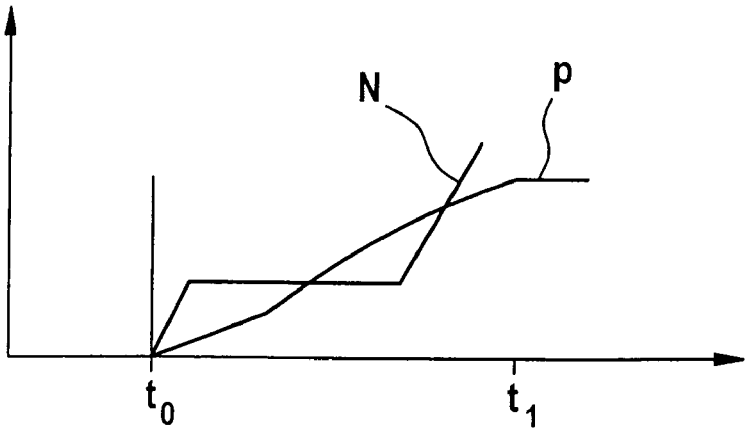
FIG. 3*b* shows, in the same view as FIG. 2*b*, the case in which the high-pressure accumulator is always filled with fuel.

FIG. 3*a* shows the same system as FIG. 2*a*, but valve 27 remains open in this case after high-pressure pump 5 is shut down. Fuel may thus continue to flow into high-pressure accumulator 10 from equalization container 30, so that high-pressure accumulator 10 always remains filled with fuel. When the internal combustion engine is restarted, high-pressure pump 5 is put into operation, valve 27 being closed. Since fuel is largely incompressible, a high pressure builds up rapidly in high-pressure accumulator 10. Correspondingly, FIG. 3*b* shows that the pressure rises immediately from instant $t_0$ and speed N of the internal combustion engine already assumes a higher value at an earlier instant. The vehicle may thus be put into operation without delay due to compression of the air bubbles in high-pressure accumulator 10.

Equalization container 30 of FIGS. 2*a* and 3*a* corresponds to leak fuel area 1 in an internal combustion engine according to FIG. 1.

Various possibilities are shown for the technical implementation in FIG. 1. Firstly, a return line 22 may be provided, which leads directly from high-pressure accumulator 10 into leak fuel area 1. A regulating valve 24, which is implemented as a check valve and allows a fuel flow only in the direction of high-pressure accumulator 10, is situated in return line 22. If the pressure in high-pressure accumulator 10 falls below the pressure in the leak fuel area due to cooling of the fuel, i.e., below the ambient pressure, fuel is decanted from leak fuel area 1 via check valve 24 and return line 22 into high-pressure accumulator 10, so that the accumulator always remains completely filled with fuel.

Return line 22', which is implemented parallel to high-pressure pump 5, operates in the same way. A check valve 24' which allows a fuel flow only in the direction of high-pressure accumulator 10 is also implemented in this return line 22'. Return line 22' may also be integrated into high-pressure pump 5 here, so that no additional installation space is required.

In order to always fill high-pressure accumulator 10 with fuel, pressure regulating valve 20 may also be used. As described above, pressure regulating valve 20 is normally used for the purpose of limiting the pressure in high-pressure accumulator 10. If pressure regulating valve 20 is opened after high-pressure pump 5 is shut down, however, termination line 15 functions as return line 22. The pressure in high-pressure accumulator 10, which is still high, is thus dissipated rapidly into leak fuel area 1 and, in addition, fuel is drawn in out of leak fuel area 1 as the pressure falls in high-pressure accumulator 10, so that high-pressure accumulator 10 always remains filled with fuel. The quantity required for this purpose is very small and is typically only a few cubic centimeters over several hours.

What is claimed is:

1. A fuel injection system for an internal combustion engine, comprising:

a high-pressure accumulator in which fuel may be stored at high pressure;

at least one fuel injector that is connectable to the high-pressure accumulator and via which fuel found in the high-pressure accumulator can be injected into a combustion chamber of an internal combustion engine;

a high-pressure pump that draws in fuel out of a leak fuel area and supplies the fuel in compressed form to the high-pressure accumulator, so that a high fuel pressure is built up therein during operation of the high-pressure pump; and a return line including a regulating valve and being implemented between the leak fuel area and the high-pressure accumulator;

wherein:

the regulating valve:

allows a fuel flow from the leak fuel area into the high-pressure accumulator when the high-pressure pump is shut down; and is configured to be switchable; and the return line continuously opens when the high-pressure pump is shut down.

2. The fuel injection system as recited in claim 1, wherein the return line leads directly from the high-pressure accumulator into the leak fuel area.

3. The fuel injection system as recited in claim 1, wherein fuel is supplied to the high-pressure pump via an intake line, the high-pressure pump conducting the compressed fuel via a high-pressure line into the high-pressure accumulator and the return line running parallel to the high-pressure pump.

4. The fuel injection system as recited in claim 1, wherein the switchable regulating valve functions as a pressure regulating valve during operation of the high-pressure pump, the pressure regulating valve being situated in a termination line and only opening this line when the pressure in the high-pressure accumulator exceeds a specific setpoint pressure, the termination line corresponding in its function to the return line.

* * * * *